US009446872B2

(12) United States Patent
Järvinen

(10) Patent No.: US 9,446,872 B2
(45) Date of Patent: Sep. 20, 2016

(54) DEVICE AND METHOD FOR OPENING A PLURALITY OF PIPING BAGS

(75) Inventor: Timo Järvinen, Norrköping (SE)

(73) Assignee: KEE PLASTICS AB, Norrkoping (SE)

( * ) Notice: Subject to any disclaimer, the term of this patent is extended or adjusted under 35 U.S.C. 154(b) by 926 days.

(21) Appl. No.: 13/639,651

(22) PCT Filed: Apr. 7, 2011

(86) PCT No.: PCT/SE2011/050422

§ 371 (c)(1),
(2), (4) Date: Apr. 9, 2013

(87) PCT Pub. No.: WO2011/126453

PCT Pub. Date: Oct. 13, 2011

(65) Prior Publication Data

US 2013/0263560 A1 Oct. 10, 2013

(30) Foreign Application Priority Data

Apr. 8, 2010 (SE) ..... 1050338

(51) Int. Cl.
*B65B 43/30* (2006.01)
*B65B 43/46* (2006.01)

(52) U.S. Cl.
CPC ..... *B65B 43/30* (2013.01); *B65B 43/465* (2013.01)

(58) Field of Classification Search
CPC ..... B65B 43/28; B65B 43/30; B65B 43/32; B65B 43/465; B65B 65/006
USPC ..... 53/459, 469, 492, 570, 202, 284.7, 53/384.1, 385.1, 386.1; 141/10, 114, 234, 141/235, 237, 247, 314
See application file for complete search history.

(56) References Cited

U.S. PATENT DOCUMENTS 2,671,587 A * 3/1954 Vogt ..... B65B 43/123 53/202
2,671,588 A * 3/1954 Vogt ..... B65B 43/123 53/202
3,871,157 A * 3/1975 Domke et al. ..... B65B 31/00 53/570
4,586,319 A * 5/1986 Ausnit ..... B65D 33/16 53/384.1
4,850,178 A * 7/1989 Ausnit ..... B65B 43/267 53/202
4,945,713 A * 8/1990 Widenback ..... B65B 43/123 53/385.1

(Continued)

FOREIGN PATENT DOCUMENTS

CA 1099601 4/1981
DE 3412254 12/1984

(Continued)

OTHER PUBLICATIONS

European Search Report dated Oct. 9, 2013 issued in corresponding European Application No. 11766252.8, 6 pages.

(Continued)

*Primary Examiner* — Stephen F Gerrity
(74) *Attorney, Agent, or Firm* — Harness, Dickey & Pierce, PLC

(57) ABSTRACT

A device for opening a piping bag for pre-filling comprises first and second gripping surfaces, adapted for clamping an openable end of the piping bag therebetween, wherein the gripping surfaces, while in clamping engagement with the piping bag, are movable relative to each other in a direction substantially parallel with said gripping surfaces. A method for opening a piping bag for prefilling is also disclosed.

7 Claims, 6 Drawing Sheets

(56) References Cited

U.S. PATENT DOCUMENTS

| | | | | | |
|---|---|---|---|---|---|
| 5,564,252 | A * | 10/1996 | Adelmann | B65B 1/02 53/202 |
| 5,862,653 | A * | 1/1999 | Solano | B65B 43/465 53/284.7 |
| 7,217,033 | B2 * | 5/2007 | Pritchard | B65B 61/005 206/390 |
| 8,001,747 | B2 * | 8/2011 | Pluckrose | B65B 43/54 53/284.7 |
| 2003/0009990 | A1 | 1/2003 | Main et al. | |
| 2009/0031678 | A1 | 2/2009 | Williamson | |
| 2012/0096812 | A1 * | 4/2012 | Ejeblad | B65B 43/262 53/384.1 |

FOREIGN PATENT DOCUMENTS

| | | | | |
|---|---|---|---|---|
| DE | 3326616 | A1 | | 1/1985 |
| DE | 202008008468 | | | 10/2008 |
| EP | 0757006 | A1 | | 2/1997 |
| GB | 651096 | | | 10/1952 |
| GB | 681096 | | | 10/1952 |
| GB | 870800 | | | 6/1961 |
| JP | 50146487 | A | | 11/1975 |
| JP | 62287813 | A | | 12/1987 |
| JP | 01240425 | A | * | 9/1989 |
| JP | 04142227 | A | * | 5/1992 |
| JP | 06199318 | A | | 7/1994 |
| JP | 08217021 | A | | 8/1996 |
| TW | 201029893 | A | | 8/2010 |
| WO | WO-9951496 | A1 | | 10/1999 |
| WO | WO-2005115153 | A1 | | 12/2005 |
| WO | WO-2005115162 | A1 | | 12/2005 |
| WO | WO-2006096076 | A1 | | 9/2006 |
| WO | WO 2010054692 | A1 | * | 5/2010 ..... B65B 43/123 |

OTHER PUBLICATIONS

International Search Report PCT/ISA/210 for International Application No. PCT/SE2011/050422 dated Jul. 21, 2011, 6 pages.

International-Type Search Report PCT/ISA/201 for SE Application No. 1050338-1 dated Oct. 7, 2010, 5 pages.

Written Opinion of the International Searching Authority PCT/ISA/237 for International Application No. PCT/SE2011/050422 dated Jul. 21, 2011, 6 pages.

International Preliminary Report on Patentability dated Oct. 18, 2012 issued in corresponding International Appln. No. PCT/SE2011/050422, 7 pages.

Australian Examination Report dated Nov. 18, 2014 issued in corresponding Australian Application No. 2011238981, 3 pages.

Taiwanese Office Action issued in corresponding Taiwanese Application No. 100121706 (with translation). 8 pages, dated Apr. 14, 2016.

* cited by examiner

DEVICE AND METHOD FOR OPENING A PLURALITY OF PIPING BAGS

PRIORITY INFORMATION

This is a National Stage of PCT/SE2011/050422 filed on Apr. 7, 2011, which is an International Application claiming priority to SE Application No. 1050338-1 filed on Apr. 8, 2010, the entire contents of which are hereby incorporated by reference.

TECHNICAL FIELD

The present document relates to a method for preparing a piping bag set for pre-filling. More particularly, the document relates to a method for opening a hermetically sealed empty piping bag prior to a filling step.

BACKGROUND

When preparing piping bags for pre-filling the bags are usually separated individually from e.g. a continuous web comprising numerous piping bags. The individual bag may then be filled, or strictly speaking pre-filled, with substances in a substantially viscous liquid or fluid form, e.g. foodstuffs, glue, cement, plaster; and subsequently sealed shut. This operation is usually time consuming as one bag at a time must be separated from the web of piping bags and arranged such as to allow for the liquid to be filled in the individual piping bag.

Piping bags made in accordance with WO2005115162A1 may, as disclosed therein, be provided, at its open end, with a weaker welding joint, which is such that upon tearing along the severance mark separating the piping bags along their openable ends, each piping bag remains closed until a user deliberately opens it. This weaker welding joint can be achieved at a low temperature and under mechanical pressure.

While the weaker welding joint is advantageous from a hygiene perspective—the piping bag remains hermetically sealed and free from contaminants until deliberately opened—it may nevertheless present a problem when the piping bag is to be prefilled in an automated pre-filling line, especially when attempting to open the bag using a vacuum-based gripping device. With the hermetic seal, a vacuum on the inside of the bag will require a great force to be applied on the outside for the bag to open. Such a great force may not be possible to apply using a vacuum, especially if the piping bag surface is slightly rough, as the one disclosed in WO2005115162A1.

Hence, there is a need for an improved device and method for opening a piping bag.

SUMMARY

It is an object of the present disclosure to provide a device and method for opening a piping bag in connection with prefilling.

The invention is defined by the appended independent claims, with embodiments being set forth in the dependent claims, in the following description and in the drawings.

According to a first aspect, there is provided a device for opening a piping bag for pre-filling. The device comprises first and second gripping surfaces, adapted for clamping an openable end of the piping bag therebetween, wherein the gripping surfaces, while in clamping engagement with the piping bag, are movable relative to each other in a direction substantially parallel with said gripping surfaces.

Such a device is able to cause the film forming the piping bag to become wrinkled, and thus the weld sealing the bag is sheared and broken.

The device further comprises first and second gripping members, with each of the gripping members carrying the respective gripping surface. The gripping members may be movable between an open position and a clamping position, for clamping the piping bag between the gripping surfaces.

At least one of the gripping surfaces may be provided with a material portion providing increased friction relative to the piping bag, as compared with a base material of the gripping member.

At least one of the gripping surfaces may present at least one vacuum connection adapted for engaging a surface portion of the piping bag.

The gripping surfaces may have substantially complementary shapes.

One of the gripping members may be substantially stationary, while another one of the gripping members may be movable.

The substantially stationary gripping member presents first and second gripping surfaces, and the device further comprises a pair of movable gripping members, each presenting a respective gripping surface being arranged to cooperate with a respective one of the first and second gripping surfaces.

According to a second aspect, there is provided a method for opening a piping bag for pre-filling. The method comprises clamping an openable end of the piping bag between a pair of gripping surfaces, moving the gripping surfaces relative to each other in a direction substantially parallel with at least one of said gripping surfaces, while the openable end of the piping bag remains clamped, and subsequently moving the gripping surfaces away from each other, while each gripping surface is in engagement with a respective portion of the piping bag.

The method can be used with any piping bag, but it is particularly advantageous for use with a piping bag having an openable end, which is hermetically sealed prior to being opened. Such hermetical sealing may be provided by e.g. a weak weld, as described above.

The engagement of the gripping surfaces may be achieved using a vacuum operating against a surface of the piping bag.

The piping bag may, prior to the clamping step, be hermetically sealed.

DESCRIPTION OF EMBODIMENTS

Figure 1:
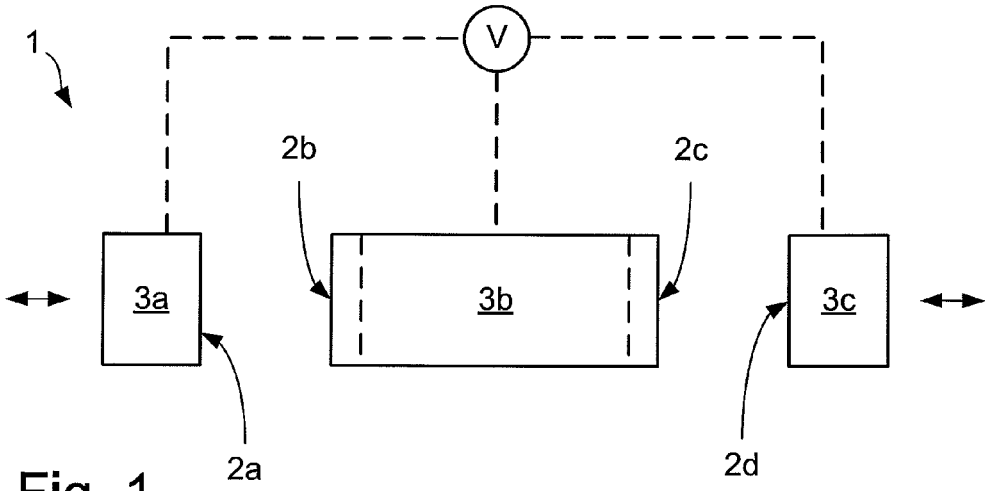
FIG. 1 is a schematic side view of a device for opening and filling piping bags.

FIG. 1 schematically illustrates a device 1 for opening and filling piping bags. The device 1 comprises three gripping members 3*a*, 3*b*, 3*c*. The first and third gripping members 3*a*, 3*c* present a respective gripping surface 2*a*, 2*d*, while the second gripping member presents two gripping surfaces 2*b*, 2*c*. In the illustrated embodiment, a first gripping assembly is formed by interacting gripping surfaces 2*a*, 2*b* of the first and second gripping members 3*a*, 3*b*. A second gripping assembly is formed by interacting gripping surfaces 2*c*, 2*d* of the second and third gripping members 3*b*, 3*c*. The second gripping member 3*b* thus presents two gripping surfaces 2*b*, 2*c*.

Figure 3:
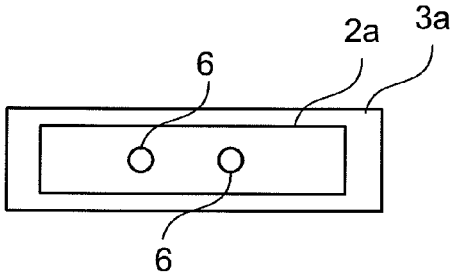
FIG. 3 is a schematic front view of a first gripping member of the device of FIG. 1.
Figure 4:
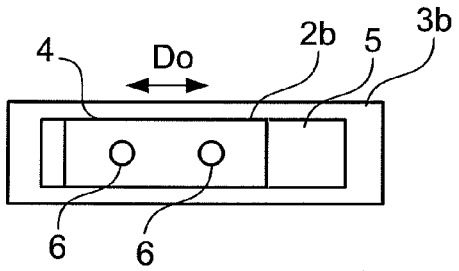
FIG. 4 is a schematic front view of a second gripping member of the device of FIG. 1.

Each gripping surface 2*a*, 2*b*, 2*c*, 2*d* is provided with at least one vacuum nozzle 6 (FIGS. 3, 4), connected to the vacuum source V, which when activated at a sufficiently low pressure is able to securely hold a piping bag.

In the illustrated embodiment, the first and third gripping members 3*a*, 3*c* may be movable in a respective direction Dg, while the second gripping member 3*b* may be substantially stationary.

Figure 2:
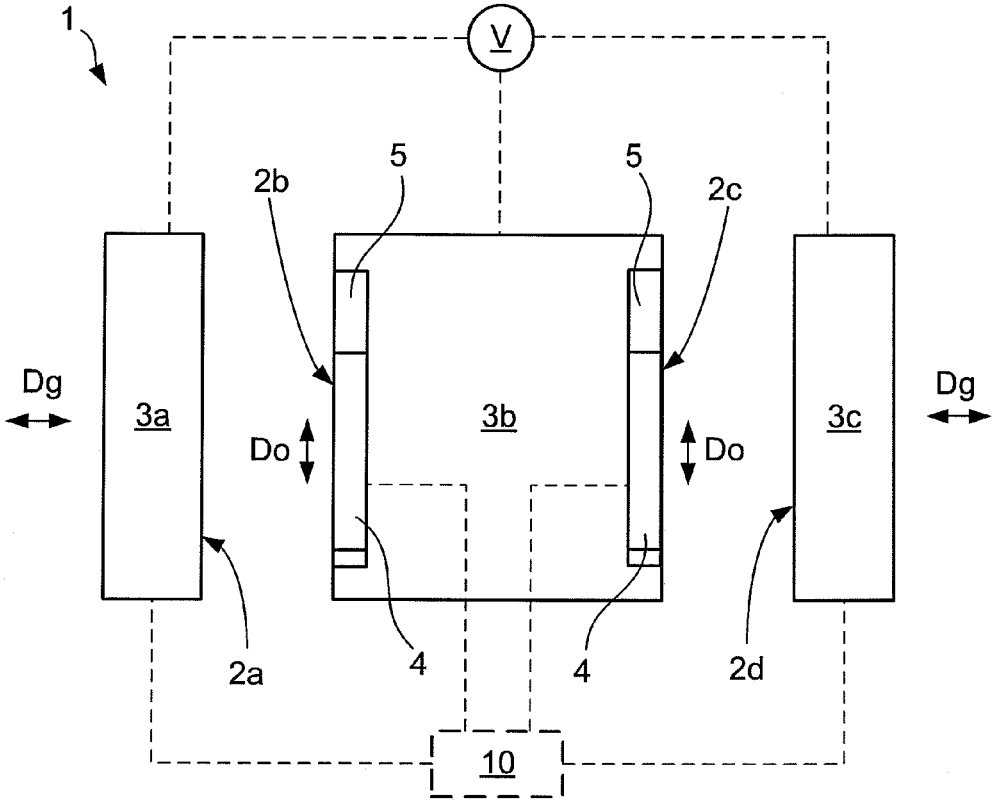
FIG. 2 is a schematic top view of the device of FIG. 1

FIG. 2 illustrates the device of FIG. 1 as seen from above. The second gripping member 3*b* is, at its gripping surfaces 2*b*, 2*c*, provided with a respective slidable member 4, which is able to move in a respective recess 5 of the wall of the second gripping member 3*b*. The movements in the directions Do of the slidable members 5 may be controlled by the system controller 10. Hence, the gripping surfaces 2*b*, 2*c* of the second gripping member 3*b* are slidable in a direction Do, which is substantially parallel with the gripping surfaces 2*a*, 2*b*, 2*c*, 2*d*, and substantially horizontal.

Hence, when a piping bag is clamped between a pair of gripping surfaces 2*a*, 2*b*; 2*c*, 2*d*, the slidable members 5 may perform a sliding movement, which may assist in breaking the weak weld at the openable portion of the piping bag.

Each gripping surface 2*a*, 2*b*, 2*c*, 2*d* may be provided with, or formed of, a material which increases the friction against the piping bag. Examples of such materials include polymer materials and rubber or rubber-like materials (e.g. TPE). It would be conceivable to use a woven or nonwoven fabric, a flocked material or even a rough, soft and/or tacky material.

Figure 5A:
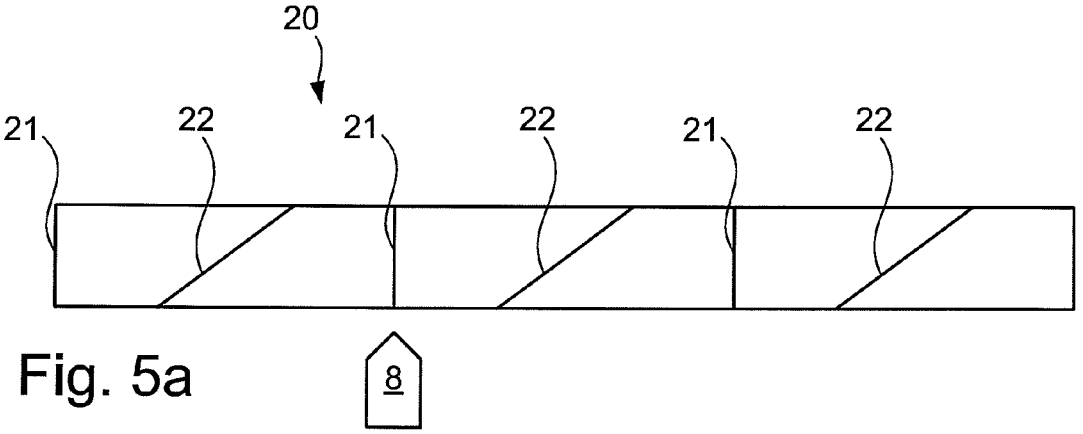
FIGS. 5*a*-5*b* are schematic plan views of piping bag blanks.

FIG. 5*a* schematically illustrates a piping bag blank 20, in the form of a tubular film portion, which is collapsed to a substantially planar state provided with a plurality of welds and severance marks such that, when individual piping bags 20" are separated from the blank 20, each individual piping bag will present an openable end 21 and an oblique welded side 22.

Figure 5B:
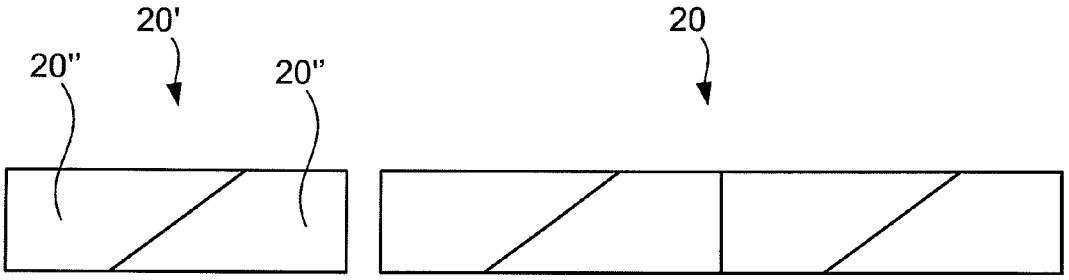

FIG. 5*b* schematically illustrates a piping bag blank 20, from which a pair 20' of piping bags has been separated. The pair 20' of piping bags is still connected along the severance mark at their oblique welded sides 22.

Referring to FIGS. 6*a*-6*h*, an operating cycle of the device 1 will now be described.

The first gripping member 3*a* may be rotatable R1 about a horizontal axis which is substantially parallel to the first gripping surface 2*a*. Furthermore, the first gripping member may be displaceable both vertically and horizontally, as illustrated by the arrow F1.

The third gripping member 3*c* may be rotatable R2 about a horizontal axis which is substantially parallel to the fourth gripping surface 2*d*. Furthermore, the third gripping member may be displaceable at least substantially vertically, as illustrated by arrow F2. A feeder 7 may be arranged to supply piping bag blanks 20, e.g. in the form of a roll. The piping bag blanks may be fed in a direction Df, as illustrated. A cutter or separator 8 may be provided to provide separation of a pair 20' of piping bags which are to be filled by the device.

Figure 6A:
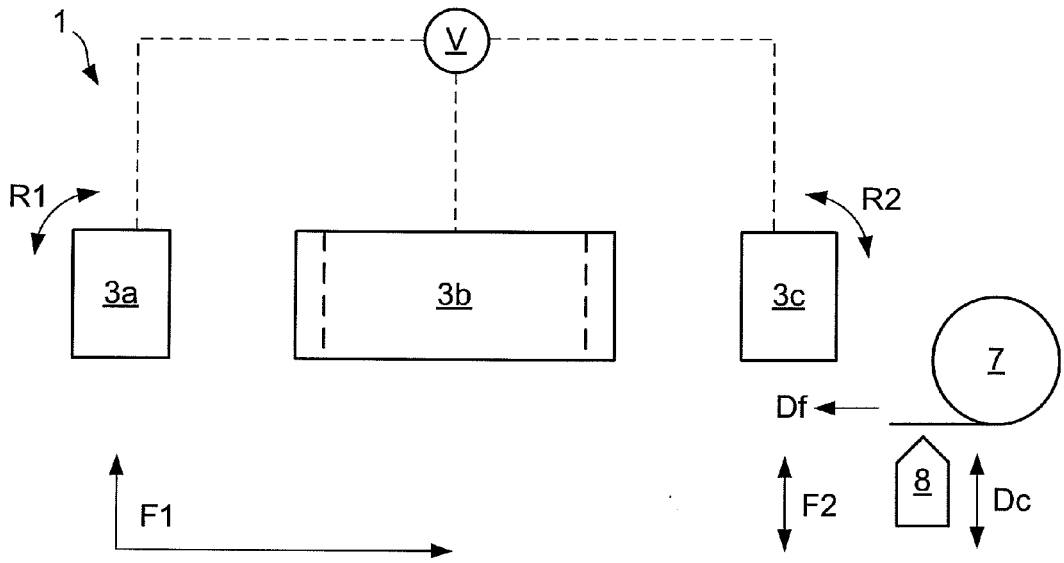
FIGS. 6*a*-6*h* are schematic views illustrating an operating cycle of the device of FIG. 1.
Figure 6B:
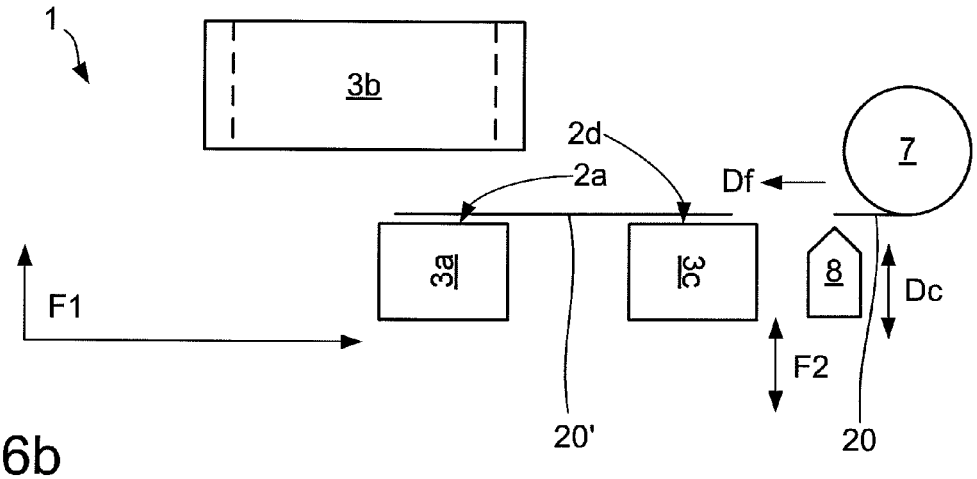

In a first step, the first gripping member 3*a* is rotated about 90° counter clockwise and displaced to its feed position as illustrated in FIG. 6*b*. The third gripping member 3*c* may be rotated about 90° clockwise and displaced substantially vertically to its feed position as illustrated in FIG. 6*b*.

When the gripping members 3*a*, 3*c* are in their respective feed position, a pair 20' of piping bags is fed from the feeder 7 and separated from the blank 20, such that a respective openable end of the piping bags 20" is grippable by the vacuum connection 6 at the respective gripping surface 2*a*, 2*d* of the respective gripping member 3*a*, 3*c*. The vacuum connections 6 are then operated to provide a vacuum at the respective gripping surface 2*a*, 2*d*, such that the respective openable end 21 of the piping bag 20" forming the piping bag pair 20' is held firmly to the gripping surface 2*a*, 2*d* by means of the vacuum.

Figure 6C:
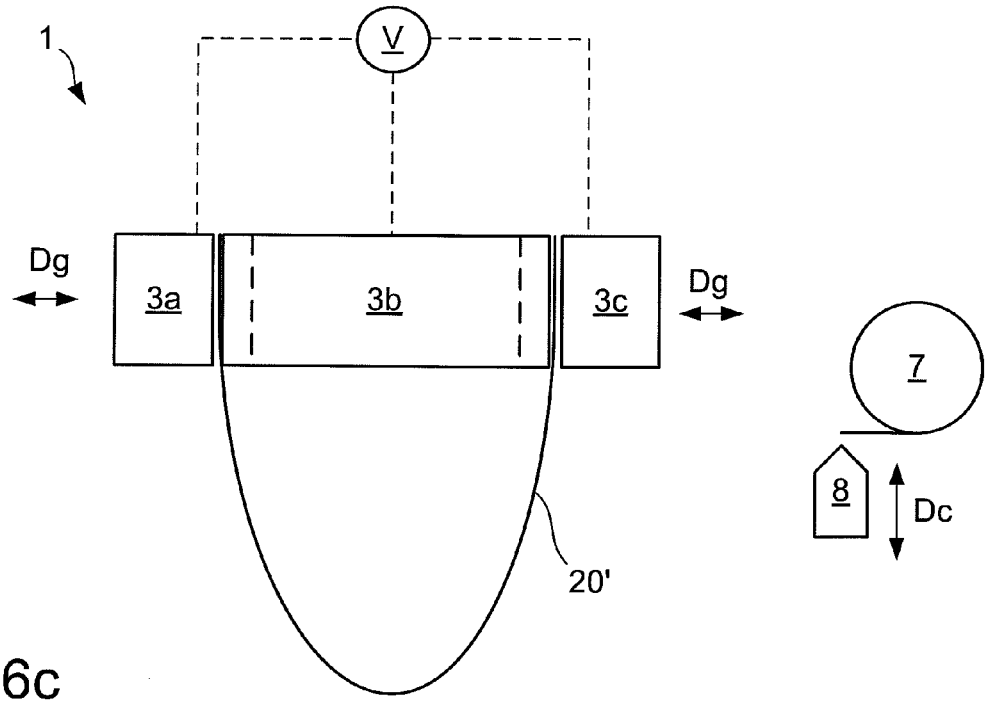

Referring to FIG. 6*c*, the gripping members 3*a*, 3*c* are then displaced back along the respective arrow F1, F2 and rotated back about 90° clockwise and counterclockwise, respectively. Furthermore, the gripping members 3*a*, 3*c* are brought along direction Dg into engagement with the respective gripping surface 2*b*, 2*c* of the second gripping member 3*b*, such that the respective openable end 21 of the piping bags is clamped between the first and second gripping surfaces 2*a*, 2*b* and the third and fourth gripping surfaces 2*c*, 2*d*, respectively.

Figure 6D:
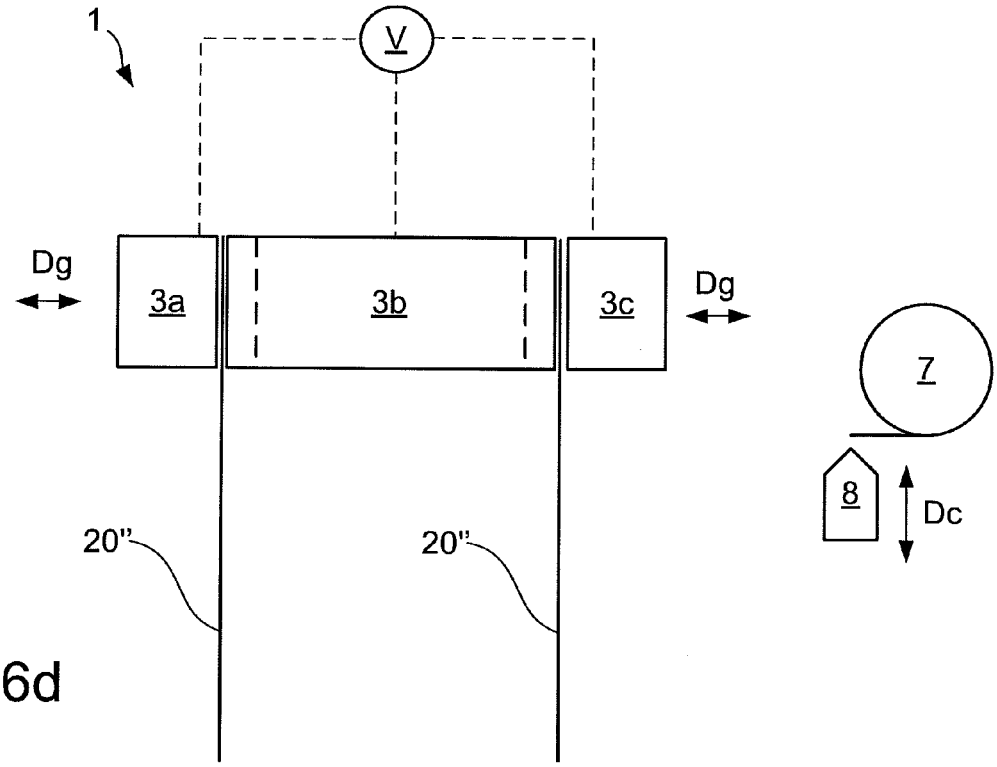

As the piping bags 20" are still attached to each other along the oblique weld/severance mark 22, they will need to be separated from each other to the configuration illustrated in FIG. 6*d*.

Figure 6E:
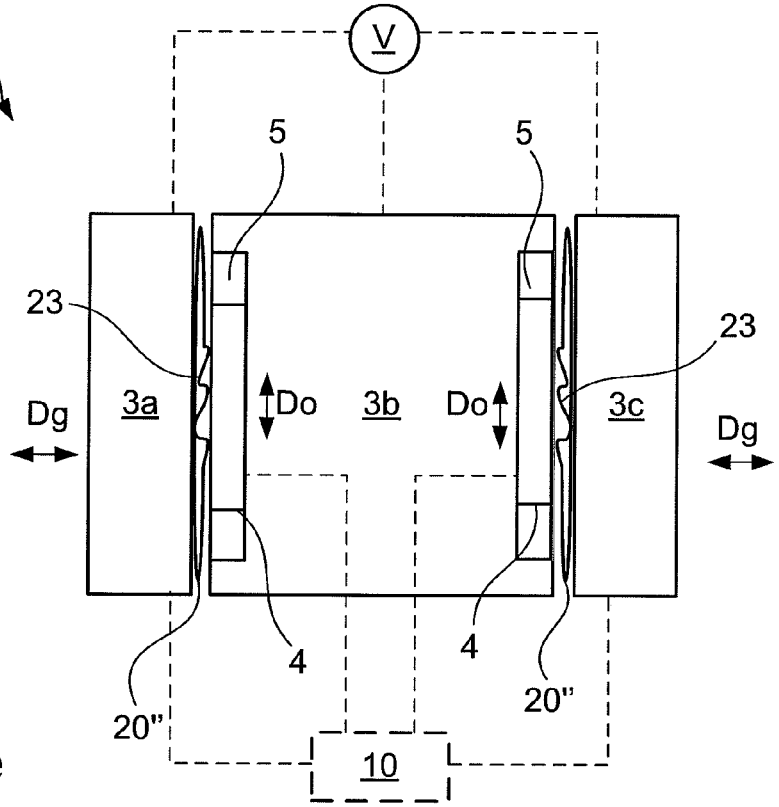
Figure 6F:
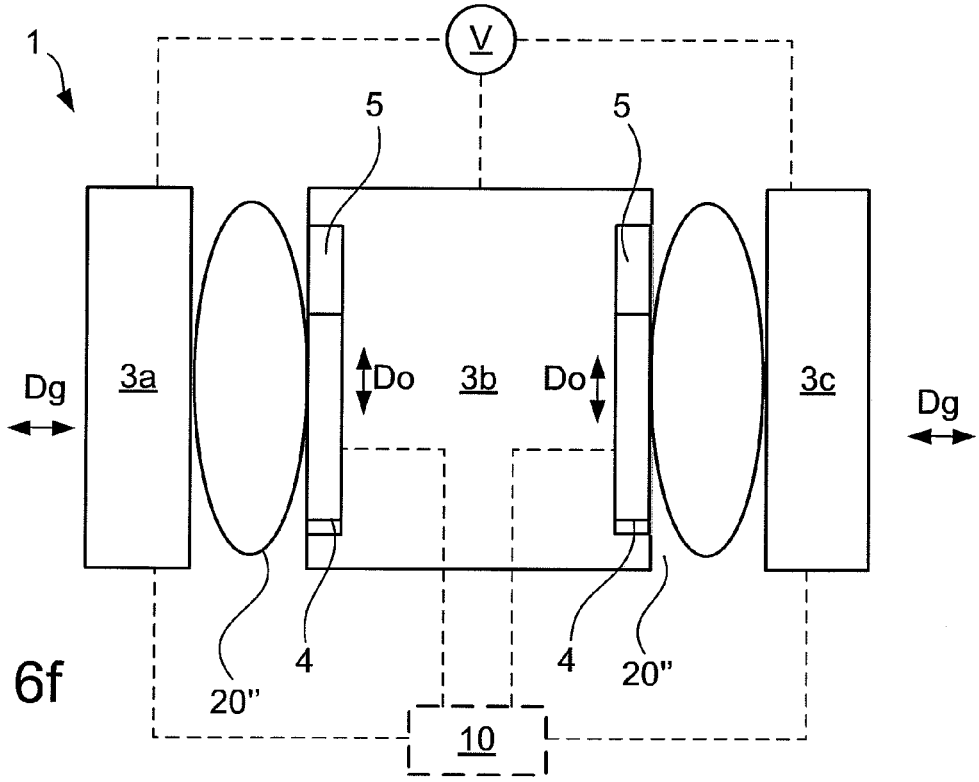

FIG. 6*e* illustrates the device 1 as seen from above. With the openable ends 21 of the piping bags 20" clamped between the gripping surfaces 2*a*, 2*b*; 2*c*, 2*d*, the slidable members 4 have been actuated and caused to perform a sliding movement in a direction Do parallel with the respective gripping surface 2*b*, 2*c*. As the friction between the gripping surfaces and the piping bag surface will counteract relative movement between the piping bag surface and the respective gripping surface, a movement will instead be provided between the film portions forming the respective half of the collapsed tube. This movement will cause the film portions to wrinkle and the weak weld sealing the openable end 21 of the piping bag 20" to break to a sufficient extent, such that the piping bag 20" can be opened by the gripping members moving Dg away from each other while portions of the bags are being held by the respective vacuum connection 6. The bags 20" will then be opened and held between the gripping surfaces 2*a*, 2*b*; 2*c*, 2*d*, as illustrated in FIG. 6*f*

Figure 6G:
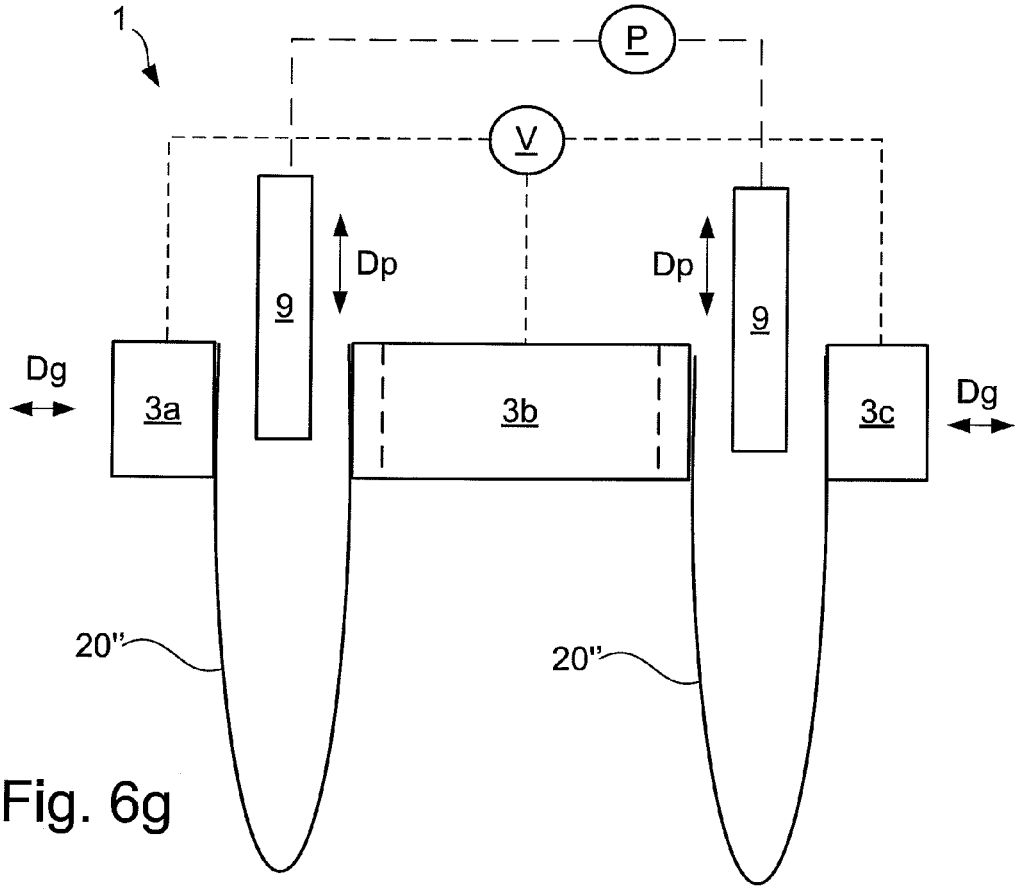

As illustrated in FIG. 6*g*, filling nozzles 9 can be introduced in a direction Dp into the now open ends 21 of the piping bags 20", whereby a flowable product can be introduced into the piping bags, e.g. from a product supply P.

In the event that a piping bag nozzle part is to be provided, e.g. as disclosed in EP0757006A, an inner part of this may be dropped into the piping bag prior to, or in connection with, the filling of the piping bag with the flowable product.

Figure 6H:
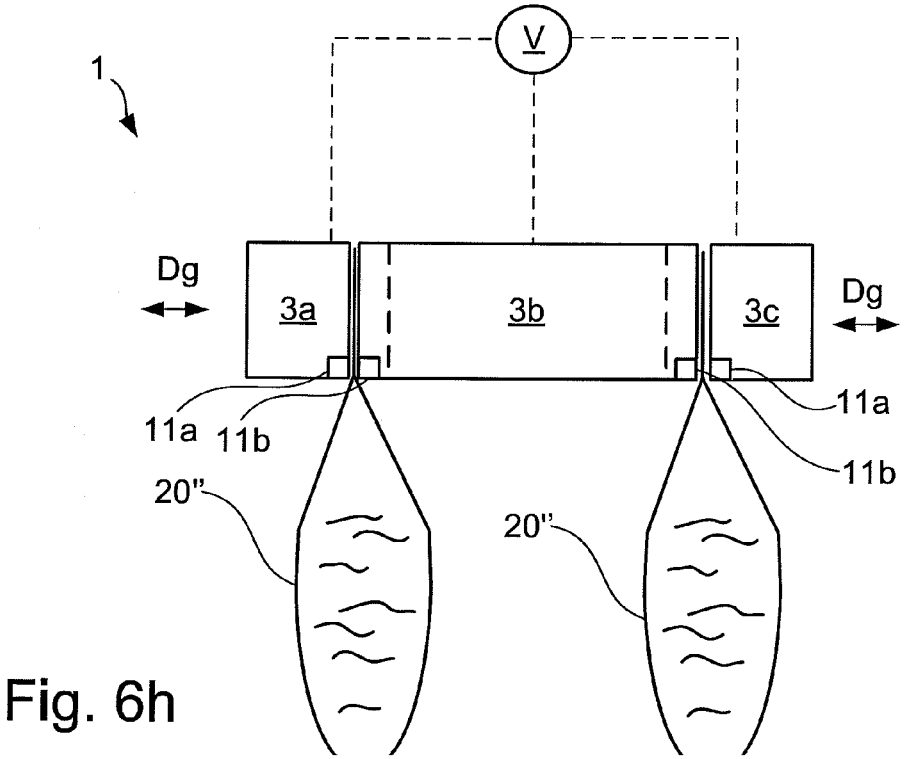

Referring to FIG. 6*h*, after the piping bags have been filled, the gripping members 3*a*, 3*c* can be displaced in the direction Dg, thereby clamping the openable ends of the piping bags, such that the piping bags 20" are closed. A welding device 11*a*, 11*b* may be arranged with one part on the movable gripping members 3*a*, 3*c* and a complementary part on the stationary gripping member 2*b*. Hence, when the gripping members 3*a*, 3*c* have been moved to clamp the openable ends 21 of the piping bags, the welding device 11*a*, 11*b* may be actuated to provide a weld, effectively sealing the piping bag.

After filling and sealing, the filled piping bags 20" may be released from the clamp between the gripping members 3*a*, 3*b*, 3*c* and allowed to drop or slide onto a conveyor device for further transportation and packaging. Other types of conveying arrangements can be used.

It is noted that further functions may be provided in connection with the filling operation, such as marking or printing of the bags. For example, a "best before" date may be printed on the bag in connection with it being filled.

The gripping surfaces 2*a*, 2*b*, 2*c*, 2*d* may be planar, as disclosed herein.

In any event, each pair of interacting gripping surfaces 2*a*, 2*b*; 2*c*, 2*d* may have complementary shapes, such as concave/convex, etc, as long as it is possible for the gripping surfaces to perform a relative movement while the gripping surfaces 2*a*, 2*b*; 2*c*, 2*d* are in engagement with each other.

The system controller 10 may be arranged to control the entire system disclosed herein: movements Dg, F1, F2, R1, R2 of gripping members 3*a*, 3*b*, 3*c*, movements Do of slidable members 4, feeder 7 (Df), actuation of vacuum source V, actuation and movement Dp of filling device 9, actuation of welding device 11*a*, 11*b*, and actuation of any conveying device.

The invention claimed is:

1. A device for opening a pair of piping bags for pre-filling, the device comprising:

a pair of first gripping members, each of the first gripping members including a fixed first gripping surface; and a second gripping member between the first gripping members, the second gripping member being substantially stationary, the second gripping member including a pair of second gripping surfaces on opposite sides of the second gripping member, each of the second gripping surfaces being proximate to a separate one of the first gripping surfaces;

each of the first gripping members being configured to move substantially orthogonally relative to the second gripping surfaces such that each of the first gripping surfaces of the first gripping members cooperate with separate second gripping surfaces to be in clamping engagement with openable ends of the piping bags; and each of the second gripping surfaces being configured to move relative to the substantially stationary second gripping member and substantially parallel with the first gripping surfaces while in clamping engagement with openable ends of the piping bags, such that the openable ends are opened.

2. The device as claimed in claim 1, wherein at least one of the first and second gripping surfaces includes a material portion, the material portion being configured to provide increased friction of a clamping engagement with at least one of the piping bags, relative to a base material of at least one of the first and second gripping members.

3. The device as claimed in claim 1, wherein at least one of the first and second gripping surfaces includes at least one vacuum connection, the vacuum connection being configured to engage a surface portion of at least one of the piping bags.

4. The device as claimed in claim 1, wherein the first and second gripping surfaces have substantially complementary shapes.

5. A method for opening a pair of piping bags for pre-filling, the method comprising:

clamping an openable end of each piping bag between a separate pair of gripping surfaces, each pair of gripping surfaces including a fixed first gripping surface of a separate first gripping member and a separate second gripping surface of a common substantially stationary second gripping member, the clamping including moving the first gripping members relative to the substantially stationary second gripping member such that the first and second gripping surfaces of each separate pair of gripping surfaces are in clamping engagement with the openable ends of the piping bags; and moving the second gripping surfaces relative to the second gripping member and substantially in parallel with the first gripping surfaces while the separate pairs of gripping surfaces are in clamping engagement with the openable ends of the piping bags such that the openable ends are opened, and subsequently moving the first gripping members away from the second gripping member while each of the first and second gripping surfaces of each pair of gripping surfaces is in engagement with respective portions of the respective piping bags.

6. The method as claimed in claim 5, further comprising:

clamping the openable end of each piping bag between a separate pair of gripping surfaces based on a vacuum operating against a surface of each piping bag.

7. The method as claimed in claim 5, wherein the piping bag is hermetically sealed, prior to the clamping.

* * * * *